US007383883B2

(12) United States Patent
Gerez et al.

(10) Patent No.: US 7,383,883 B2
(45) Date of Patent: Jun. 10, 2008

(54) APPARATUS AND METHOD TO DETECT A SIGNAL ASSOCIATED WITH A COMPONENT

(75) Inventors: David Gerez, Houston, TX (US); Cesar Gama, Sugar Land, TX (US); Ethan Chabora, Kenai, AK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 268 days.

(21) Appl. No.: 11/161,737

(22) Filed: Aug. 15, 2005

(65) Prior Publication Data

US 2007/0034374 A1 Feb. 15, 2007

(51) Int. Cl.
*E21B 47/09* (2006.01)

(52) U.S. Cl. ..... 166/255.1; 166/66; 166/66.5

(58) Field of Classification Search ..... 166/255.1, 166/66, 66.5
See application file for complete search history.

(56) References Cited

U.S. PATENT DOCUMENTS 5,541,889 A * 7/1996 Priest et al. ..... 367/35
6,003,597 A 12/1999 Newman
6,378,607 B1 4/2002 Ryan
6,945,330 B2 * 9/2005 Wilson et al. ..... 166/373
2002/0185275 A1 12/2002 Yang et al.
2003/0188867 A1 10/2003 Parrott
2005/0247484 A1 * 11/2005 Brune et al. ..... 175/45

FOREIGN PATENT DOCUMENTS

| | | |
|---|---|---|
| EP | 0412535 A1 | 2/1991 |
| GB | 2195023 A | 3/1988 |
| GB | 2374887 A | 10/2002 |
| GB | 2390627 A | 1/2004 |
| WO | 1997021117 | 6/1997 |

* cited by examiner

*Primary Examiner*—David J. Bagnell
*Assistant Examiner*—Nicole Coy
(74) *Attorney, Agent, or Firm*—Dan C. Hu; Kevin B. McGoff; Bryan P. Galloway

(57) ABSTRACT

An apparatus for use in a well comprises a structure having at least a first portion formed of a first material, and a detector to detect a signal associated with a component located either within or beyond the structure. The first material has a property that reduces attenuation of the signal.

23 Claims, 4 Drawing Sheets

APPARATUS AND METHOD TO DETECT A SIGNAL ASSOCIATED WITH A COMPONENT

BACKGROUND

Various components are provided into a well to complete the well. Such components include casing, tubing strings, control lines, sensors, control devices, valves, packers, mandrels and so forth. Once such components are installed, a perforating operation is typically performed to extend perforations through tubings and/or casing and into the surrounding formation. The perforations enable the communication of fluids between the surrounding formation and the wellbore.

To perform a perforating operation, a perforating gun is lowered into the well to a target depth. However, prior to firing the perforating gun, a well operator has to first ensure that the perforating gun will not fire in a direction that would destroy downhole components such as control lines, sensors, control devices, tubing strings, and so forth. Conventionally, various orientation techniques have been employed to identify a direction of perforation for the perforating gun that would not destroy downhole components.

One technique that has been employed is to use detection tools that emit an electromagnetic field and that can detect distortion in the magnetic field induced by a target component (such as a tubing string, control line, sensor, a mass positioned at a predetermined location, and so forth). The distortion can be used to determine the location of the target component. However, if a ferromagnetic layer (such as the layer of a steel casing or steel tubing) is provided between the target component and the detector tool, or beyond the target component and the detector tool, then the ferromagnetic layer can potentially interfere with accurate detection of the location of the target component based on detecting distortion caused by the target component.

The inability to accurately detect the location of a downhole component may result in destruction of the component if a perforating gun is inadvertently fired in the direction of such component. Usually, it is quite expensive to replace the destroyed component, since completion hardware must be removed from a well to perform replacement or repair operations.

SUMMARY

In general, according to an embodiment, an apparatus for use in a well comprises a structure having at least a first portion formed of a first material, and a detector to detect a signal associated with a component located either within or beyond the structure, where the first material has a property that reduces attenuation of the signal.

Other or alternative features or embodiments will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

As used here, the terms "up" and "down"; "upper" and "lower"; "upwardly" and downwardly"; "upstream" and "downstream"; "above" and "below"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate.

Figure 1A:
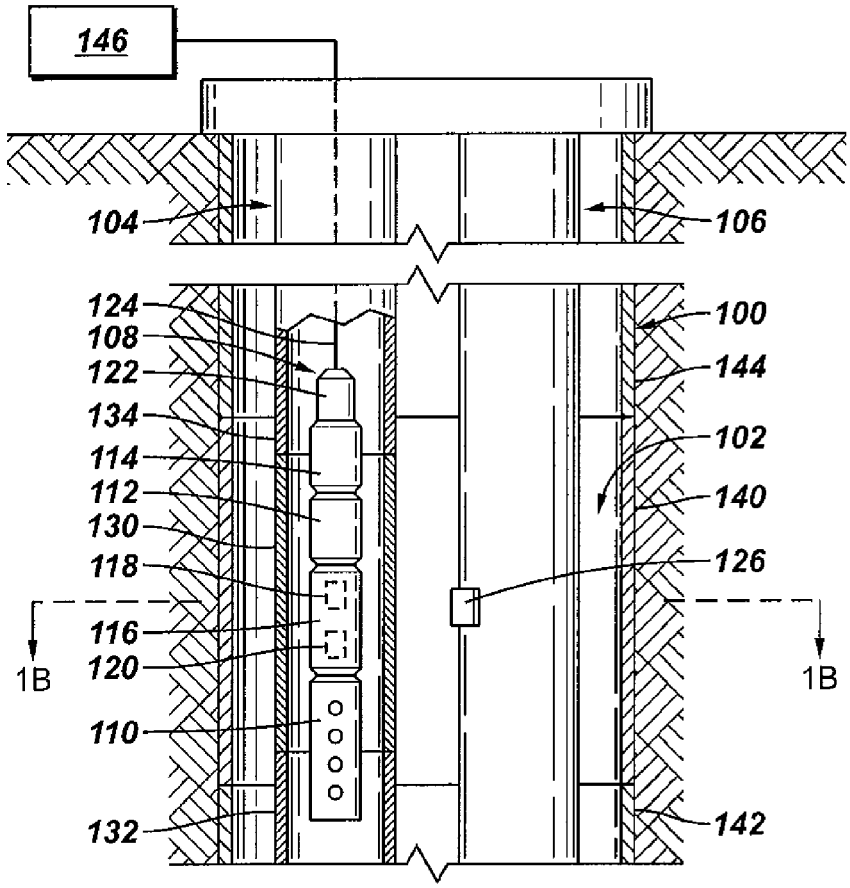
FIG. 1A illustrates a multi-string completion arrangement that has multiple tubing strings, where a tool is positioned in one of the tubing strings, in accordance with an embodiment.
Figure 1B:
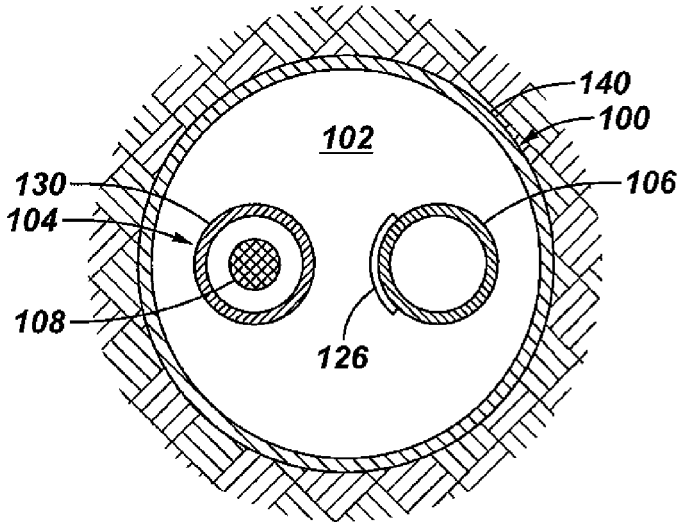
FIG. 1B is a cross-sectional view of a section of the completion of FIG. 1A.

Referring to FIGS. 1A-1B, a completion according to a first arrangement includes a casing 100 inside a wellbore 102. FIG. 1A is a side view of the completion, while FIG. 1B is a cross-sectional view of the completion taken along section 1B-1B in FIG. 1A. Multiple tubing strings 104 and 106 are positioned in the wellbore 102. A tool string 108 is lowered through an inner bore of the tubing string 104. The tool string 108 has a tool 110 that contains an explosive device that when detonated causes an explosive force in a particular direction or range of directions in the wellbore 102, aiming or not to reach the formation outside casing 100. An example of such a tool 110 is a perforating gun that has shaped charges. A shaped charge when fired causes a perforating jet to fire in a particular direction. The perforating gun can have shaped charges arranged such that the shaped charges fire in one direction, or in a range of directions (such as within a 30° angle, a 45° angle, etc.). There are cases where the intention of the perforating job is just open holes in the tubing 130 and not compromise the casing 100. Other cases as referred above, aim to open holes in the tubing 130 and the casing 100 allowing fluid from the formation to migrate to the wellbore 102 and consequently tubing 130.

It is desired that the explosive device in tool 110 when fired does not cause damage to the other tubing string 106. Thus, the tool 110 is oriented such that the explosive device of the tool 110 fires in a direction (or directions) away from the tubing string 106. In an alternative arrangement, another component can be located in the wellbore 102 in addition to or instead of the tubing string 106. Such other component can include a sensor, a control device, a control line, an electric cable, or some other downhole component that should not be damaged by firing of the explosive device in the tool 110.

To accomplish orientation of tool 110, the tool string 108 includes a motor 112 that is able to rotate the tool 110 with respect to the remaining portion of the tool string 108. To fix the position of the tool string 108 inside the tubing string 104, the tool string 108 includes an anchor module 114. Note that multiple anchor modules can be provided in the tool string 108, although only one is depicted in FIG. 1A. In some implementations, the anchor module 114 is able to centralize the tool string 108 within the tubing string 104. In different implementations, the anchor module 114 is able to fix the tool string 108 in a decentralized manner within the tubing string 104.

Once the anchor module 114 is set, activation of the motor 112 is able to rotate the tool 110 along with other parts of the tool, such as the portion including a sonde 116. A "sonde" refers to a device that is part of the tool string 108 used for detecting an azimuthal location of another component in the wellbore. The "azimuthal location" of a component refers to the angular orientation of the component around the circumference of the wellbore. In other words, this angular orientation is measured in a plane that is generally perpendicular to an axis of the wellbore interval where the measurement is taking place.

In the arrangement depicted in FIG. 1A, the sonde 116 includes a transmitter 118 (optional) and a detector 120. Whether the transmitter 118 is present in the sonde 116 depends upon the type of sonde 116 used in the tool string 108. For example, for a sonde 116 that detects an azimuthal location of a target component in the wellbore based on nuclear signals (e.g., gamma-ray radiation), the transmitter 118 can be omitted. However, for sondes 116 that perform detection of azimuthal locations of downhole components based on electromagnetic or acoustic signals, then the transmitter 118 is provided in the sonde 116 to generate the electromagnetic or acoustic signals, in some implementations.

The detector 120 in the sonde 116 is used to detect a signal (or signals) associated with the target component to be detected by the sonde 116. In the example of FIGS. 1A-1B, the target component to be detected is the tubing string 106. In the example implementation of FIG. 1A, a tag 126 is attached to the tubing string 106 to enhance the signal associated with the tubing string 106 that is detectable by the detector 120. For example, if detection of the azimuthal location of a target component is based on electromagnetic or acoustic signals, then the tag 126 is a component to enhance distortion of a magnetic field or to increase reflection of acoustic signals, respectively. The tag 126 can be formed of a ferromagnetic material to enhance distortion of the magnetic field. Alternatively, the tag 126 can also be formed of a material having a property to enhance reflections of acoustic signals. In yet another implementation, the tag 126 can be a source of gamma-ray radiation or other nuclear signals, where such tag 126 emits the signals for detection by the detector 120. If detection of azimuthal location is based on nuclear signals, then the tag 126 can be a nuclear signal transmitter (e.g., a transmitter of gamma ray signals).

The tag 126 can be omitted in other implementations. Also, alternatively, instead of being attached to the tubing string 106, the tag 126 can be positioned away from the tubing string 106 (e.g., at a 180° offset, 90° offset, or other offset from the tubing string 106). By positioning the tag 126 at a location that is azimuthally or angularly offset from the tubing string 106, the explosive device in the tool 110 can be oriented to shoot toward the tag 126 to avoid shooting in the direction of the tubing string 106.

Note that the target component to be detected by the sonde 116 is located "beyond" the tubing string 104. A component is said to be located "beyond" a structure from the sonde 116 if the component is separated from the sonde 116 by the structure. Thus, in the arrangement of FIGS. 1A-1B, the structure is the tubing string 104, the sonde 116 is located in the inner bore of the tubing string 104, and the target component (tubing string 106 and/or tag 126) whose azimuthal location is to be detected is located beyond (outside) the tubing string 104.

In the implementation where the sonde 116 employs electromagnetic signals, an alternating electric current is supplied to an exciter coil (such as a solenoid-type coil) in the transmitter 118. The exciter coil produces a primary electromagnetic flux field (a magnetic field). The magnetic field propagates radially into the surrounding tubing string 104 wall and surrounding wellbore environment. The magnetic field is distorted by components in the surrounding environment, including the tubing string 106 and tag 126 (if present). The distorted magnetic field is received by a reference coil (or detector coil), or plural reference or detector coils, in the detector 120.

The distortion of the magnetic field caused by the components in the surrounding wellbore environment causes changes in amplitude and phase of signal(s) received by the detector 120, where the signal(s) result(s) from the distorted magnetic field. The signal(s) received by the detector 120 is(are) considered a signal(s) associated with a target component such as the tubing string 106 and/or tag 126.

The received signal(s) is(are) provided to a control module 146 (which can be located at the earth surface or somewhere in the wellbore 102). The control module processes the signal(s) and determines the azimuthal location of the tubing string 106 based on processing the signal(s). If the control module is located at the earth surface, the received signal(s) by the detector 120 are communicated to such control module by a telemetry module 122 over a cable 124. The cable 124 can be an electric cable, a fiber optic cable, or some other type of communications cable.

In accordance with some embodiments of the invention, to reduce attenuation of signals caused by the tubing string 104, at least a section 130 of the tubing string 104 (in the proximity of the sonde 116) is formed of a material that has a property to reduce attenuation of signals received by the detector 120 for the purpose of detecting an azimuthal location of the tubing string 106. The section 130 is in an interval where detection of the azimuthal location of a target component is to occur.

Note that in some embodiments, the tubing string 104 has just a section 130 that is formed of the first material. The remaining sections (132, 134) of the tubing string 104 can be formed of a second material that causes greater attenuation of signals than the first material. The term "attenuation" or "attenuate" when referring to signals received by the sonde 116 for detecting the azimuthal location of another component in the wellbore refers to reduction by interference, reduction by absorption, increase in background noise, or other type of masking that reduces the ability of the sonde 116 to accurately determine the azimuthal location of the component in the well.

As an example, to reduce attenuation of a magnetic field generated by the transmitter 118 in the sonde 116, the first material forming the section 130 of the tubing string 104 is made of a non-ferromagnetic material such as stainless steel, titanium, fiberglass, and so forth. Because stainless steel, titanium, and fiberglass are typically more expensive than steel (which is the material normally used to form tubing strings in a well), the amount of such non-ferromagnetic materials is limited in the tubing string 104 to reduce costs. Consequently, in the implementation depicted in FIG. 1A, only the section 130 of the tubing string 104 is formed of the non-ferromagnetic material. The remaining sections 132, 134 of the tubing string 104 are formed of a ferromagnetic material (e.g. steel). However, in other implementations, the entire tubing string 104 can be formed of the non-ferromagnetic material.

In the implementation where the sonde 116 detects the azimuthal location of the target component based on acoustic detection, the transmitter 118 in the sonde 116 emits acoustic pings radially outwardly. The detector 120 in the sonde 116 receives reflected acoustic signals from surrounding structures, such as the tubing string 106 and/or tag 126. The azimuthal location of the target component is determined based on the reflected acoustic signals.

To reduce attenuation of acoustic signals reflected from the target component, it is desired that the section 130 of the tubing string 104 in the proximity of the sonde 116 be formed of a first material that reduces reflection of acoustic signals transmitted from the sonde 116. Generally, each interface (e.g. interface between fluid and tubing wall surface, interface between fluid and target component surface, etc.) will cause reflection of acoustic signals. Reflected acoustic signals from the interfaces of the tubing string 104 wall and surrounding fluid are considered noise that causes reduction in the ability to detect reflected acoustic signals from the target component. Thus, instead of using steel in the tubing string section 130 (which is associated with relatively high velocities of reflections), an alternative material (e.g., chrome, plastic, rubber, etc.) can be used instead in the tubing string section 130 to reduce amplitudes of acoustic reflections from the tubing string 104. The section 130 thus is formed of a material that has a lower acoustic reflection property. The reduction of the amplitudes of acoustic reflections from the tubing string 104 results in improved signal-to-noise ratio so that the acoustic signals reflected from the target component can be better detected by the sonde 116. In other words, the section 130 of the tubing string 104 is said to reduce attenuation of the acoustic signals (reflected acoustic signals) associated with the target component.

In an alternative implementation, instead of the sonde 116 emitting acoustic signals that are reflected by the target component (e.g., tubing string 106 and/or tag 126), a source of acoustic signals can be provided, where the acoustic signal source emits acoustic signals that are received by the sonde 116. The acoustic signal source can be provided in the tag 126, or in a location away from the tubing string 106. In this alternative implementation, forming the section 130 of the tubing string 104 out of a material with reduced acoustic reflection property similarly enhances the ability of the sonde 116 to more accurately detect the azimuthal location of the target component. Another source of acoustic signal may be another tool string 108 located inside the tubing 106. In this configuration, the source 118 will generate the acoustic signal and will be detected on the tool 108 inside the tubing 104.

In the implementation where the sonde 116 detects the azimuthal location of the target component based on nuclear signals (e.g. gamma-ray radiation), the sonde 116 does not include the transmitter 118. Instead, the sonde 116 includes the detector 120 to receive nuclear signals emitted by a nuclear-signal source (e.g., gamma-ray radiation source) in the tag 126. The azimuthal location of the target component is determined based on the emitted nuclear signals.

To reduce attenuation of the nuclear signals emitted by the tag 126 in this implementation, the section 130 of the tubing string 104 can be (1) formed of a material that reduces absorption of nuclear radiation as compared to steel or other typical material used to form the tubing string 104; or (2) formed of a thinner layer of material (e.g., thinner layer of steel) to reduce absorption of nuclear radiation. In other words, the section 130 of the tubing string 104 is said to reduce attenuation of the emitted nuclear signals associated with the target component (tag 126).

In the example embodiment shown in FIG. 1A, the casing 100 also has a section 140 that is formed of a material to reduce attenuation of signals received by the detector 120 for the purpose of detecting an azimuthal location of the tubing string 106. It has been observed that a steel casing surrounding the sonde 116 may introduce background noise, causing attenuation of signals all around the circumference of the casing such that the detector 120 is unable to accurately detect the azimuthal location of the tubing string 106 and/or tag 126. To reduce this attenuation, the section 140 of the casing 100 is formed of a material (e.g., non-ferromagnetic material) that allows a reduction of the attenuation. In the implementation shown in FIG. 1A, only the section 140 of the casing 100 is formed of the first material. The remaining parts 142 and 144 of the casing 100 are formed of the typical material used to form the casing, such as steel or other material.

Figure 2A:
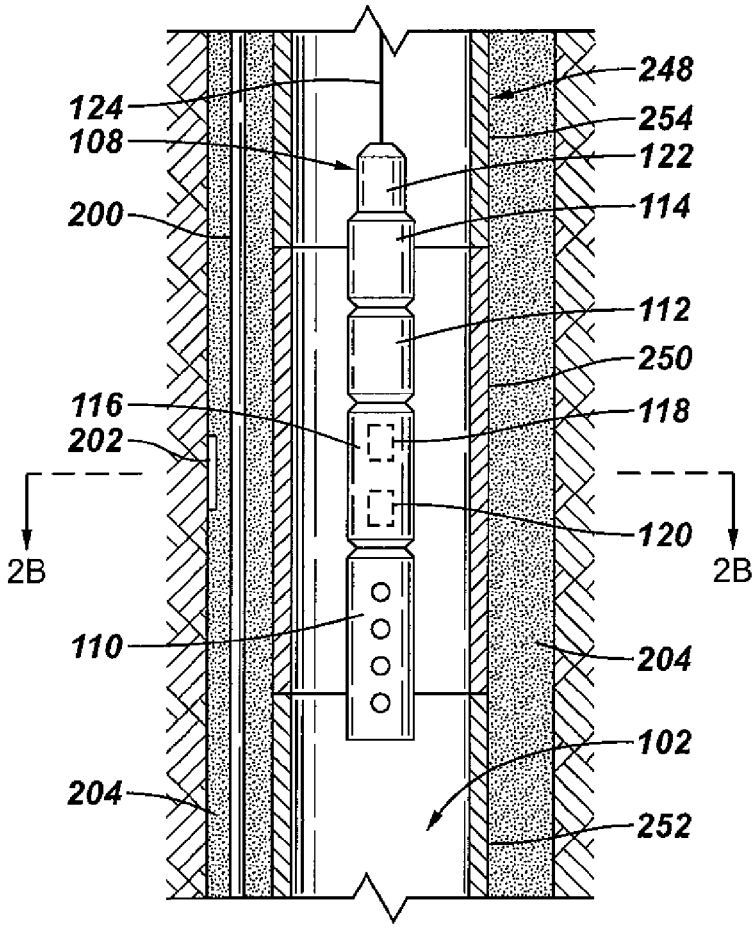
FIG. 2A illustrates a completion arrangement having a casing and a control line located outside the casing, where a tool is positioned inside the casing, according to another embodiment.
Figure 2B:
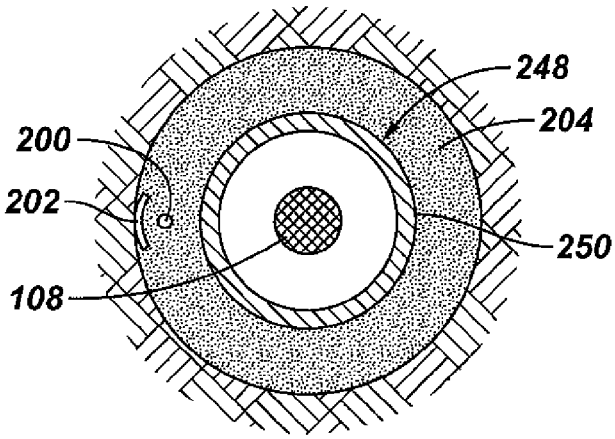
FIG. 2B is a cross-sectional view of a section of the completion of FIG. 2A.

FIGS. 2A-2B illustrate a completion according to another arrangement in which the tool string 108 (identically configured as the tool string 108 of FIG. 1A) is used to detect the azimuthal location of a control line 200 that is located outside the casing 248. FIG. 2A is a side view of the completion, and FIG. 2B is a cross-sectional view of the completion taken along line 2B-2B. Note that in the arrangement of FIGS. 2A-2B, tubing strings are not provided in the interval where the tool string 108 is located. As depicted in FIGS. 2A-2B, the control line 200 is located inside a cement layer 204 that cements the casing 248 to the wellbore wall.

An optional tag 202 can be positioned close to the control line 200 to enhance the ability of the sonde 116 in the tool string 108 to detect the azimuthal location of the control line 200. Alternatively, the optional tag 202 can be positioned at an azimuthally offset location from the control line 200 such that an explosive force can be directed towards the tag 202 to avoid damaging the control line 200. In alternative implementations, instead of the control line 200, sensors, control devices, and other target components can be positioned outside the casing 248 in the cement layer 204.

As with the implementation of FIGS. 1A-1B, a section 250 of the casing 248 (in the interval where the azimuthal location of a target component is to be detected) is formed of a first material having a property that reduces attenuation of a signal associated with the target component (e.g., control line 200 and/or tag 202). For example, for the implementation where the sonde 116 emits a magnetic field, the section 250 of the casing 248 is formed of a non-ferromagnetic material, whereas the remaining sections 252, 254 of the casing 248 are formed of a ferromagnetic material. Alternatively, the entire casing 248 can be formed of the non-ferromagnetic material.

In the implementations where the sonde 116 detects the azimuthal location of a target component based on acoustic or nuclear signals, the section 250 of the casing 248 (or the entire casing 248) is formed of a material to reduce attenuation of reflected acoustic signals or nuclear signals associated with the target component (e.g., control line 200 and/or tag 202).

Figure 3A:
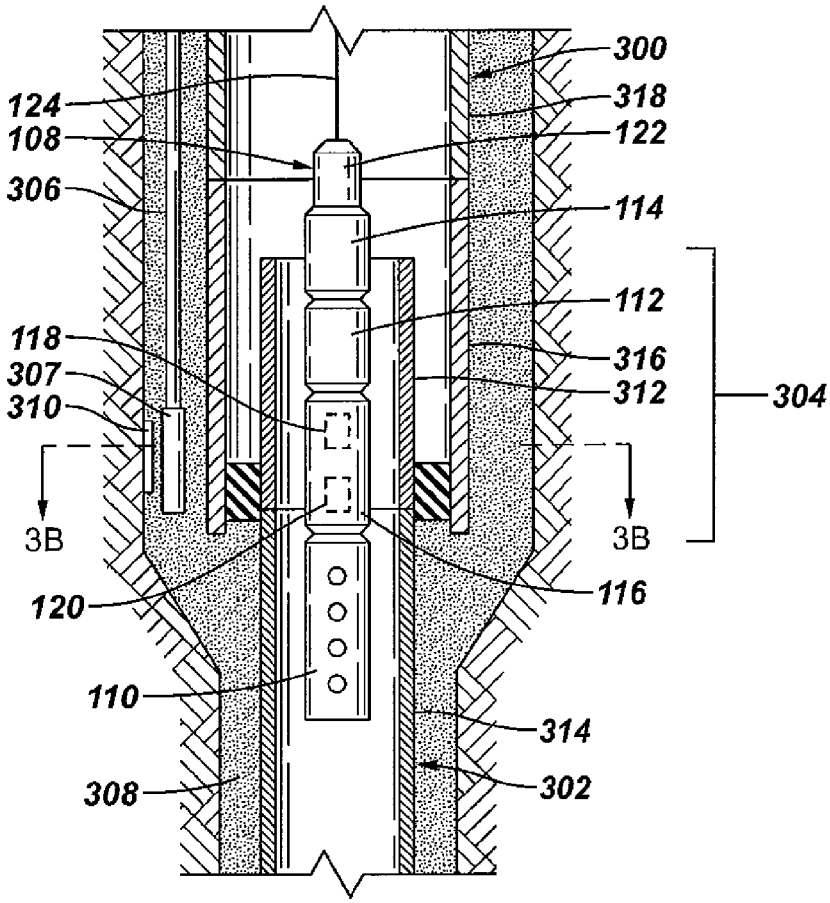
FIG. 3A illustrates a completion arrangement having multiple casings and a device outside the casings, where a tool is positioned inside the casings, according to yet another embodiment.
Figure 3B:
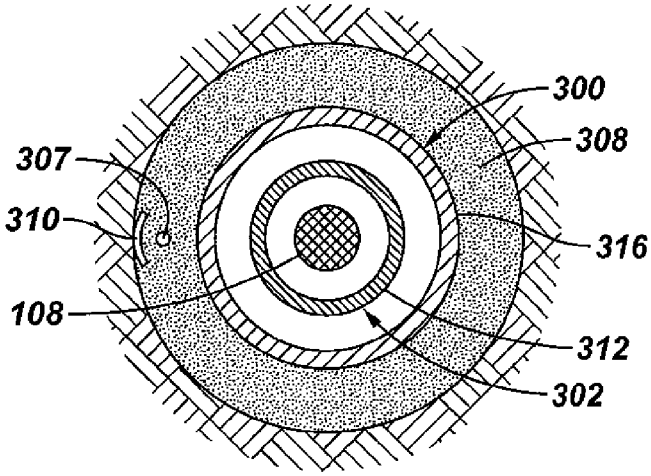
FIG. 3B is a cross-sectional view of a section of the completion of FIG. 3A.

FIGS. 3A-3B illustrate a completion according to yet another arrangement. FIG. 3A is a side view of the completion, and FIG. 3B is a cross-sectional view of the completion taken along line 3B-3B. In the arrangement of FIGS. 3A-3B, multiple casings 300 and 302 are depicted, where a first casing 300 has a wider diameter than a second casing 302. A section 312 of the second casing 302 overlaps a section 316 of the first casing 300 in an interval 304. A component 307 (such as a sensor, control device, or other equipment) is located outside the first casing 300, where such component is provided in a cement layer 308. The component 307 is connected by a cable 306 to other equipment. An optional tag 310 is provided enables the sonde 116 in the tool string 108 to detect the azimuthal location of the tag 310 or component 307. Alternatively, the optional tag 310 is azimuthally offset from the component 307. The section 312 of the second casing 302 is formed of the first material that reduces attenuation of signals used for detecting the azimuthal location of the target component. In the implementation of FIG. 3A, a second section 314 of the second casing 302 is formed of a second material that is different from the first material. Optionally, the section 316 of the first casing 300 can be formed of the first material that reduces attenuation of signals used for detecting the azimuthal location of the target component, while a remaining part 318 of the first casing 300 is formed of the second material.

Note that the tool 108 in FIG. 3A can be located inside a tubing string (not shown) that is inside the casing 302.

Figure 4A:
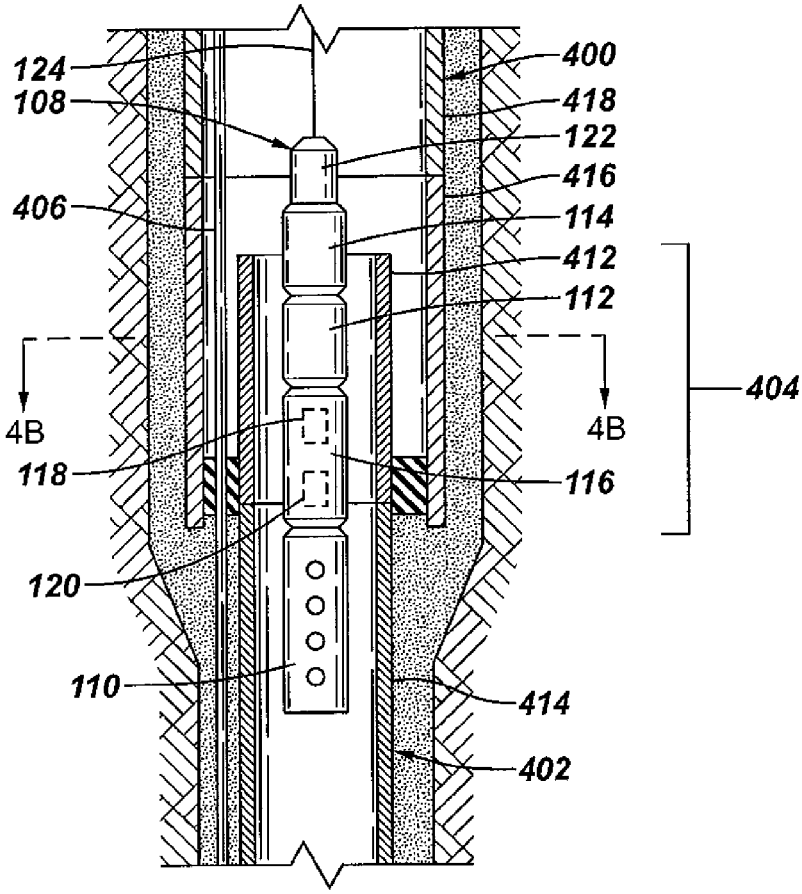
FIG. 4A illustrates a completion arrangement having multiple casings and a control line extending through a space between the casings, where a tool is positioned inside the casings, according to yet a further embodiment.
Figure 4B:
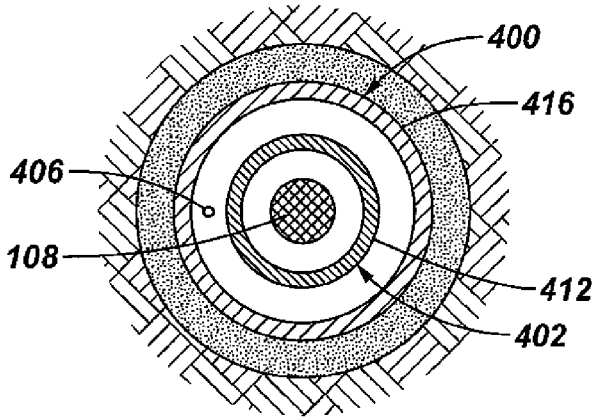
FIG. 4B is a cross-sectional view of a section of the completion of FIG. 4A.

FIGS. 4A-4B illustrate a completion according to yet another arrangement. FIG. 4A is a side view of the completion, and FIG. 4B is a cross-sectional view of the completion taken along line 4B-4B. In the arrangement of FIGS. 4A-4B, multiple casings 400 and 402 are depicted, where a first casing 400 has a wider diameter than a second casing 402. A section 412 of the second casing 402 overlaps a section 416 of the first casing 400 in an interval 404. A control line 406 extends through a space between the first and second casings 400, 402. The sonde 116 in the tool string 108 is able to detect the azimuthal location of the control line 406 in the interval 404. The section 412 of the second casing 402 is formed of the first material that reduces attenuation of signals used for detecting the azimuthal location of the control line 406. In the implementation of FIG. 4A, a second section 414 of the second casing 402 is formed of a second material that is different from the first material. The section 416 of the first casing 400 is also formed of the first material that reduces attenuation of signals used for detecting the azimuthal location of the control line 406, while a remaining part 418 of the first casing 400 is formed of the second material.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. An apparatus for use in a well, comprising:

a component;

a tubular structure having a first portion formed of a first material; and a detector lowered through the tubular structure to detect a signal associated with the component, wherein the tubular structure is located between the detector and the component, wherein the first material has a property that reduces attenuation of the signal, and wherein the tubular structure has a second portion formed of a second material, the second material to attenuate the signal more than the first material.

2. The apparatus of claim 1, wherein the first portion of the tubular structure is located in closer proximity to the component than the second portion of the tubular structure.

3. The apparatus of claim 1, wherein the signal is selected from among a magnetic signal, a nuclear signal, and an acoustic signal.

4. The apparatus of claim 1, wherein the tubular structure comprises a tubular conduit having an inner bore, the component located outside the tubular conduit, and the detector located in the inner bore.

5. The apparatus of claim 4, wherein the tubular conduit comprises a first tubing, and the component comprises one of a second tubing, a control line, and a device.

6. The apparatus of claim 4, wherein the tubular conduit comprises a first casing.

7. The apparatus of claim 1, wherein the detector comprises at least one element selected from among a detector coil to detect magnetic field distortion caused by the component, an acoustic detector to detect an acoustic signal from the component, and a nuclear signal detector to detect an emitted nuclear signal.

8. An apparatus for use in a well, comprising:

a first casing having an inner bore and at least a first portion formed of a first material; and a detector to detect a signal associated with a component located beyond the first casing, wherein the first material has a property that reduces attenuation of the signal, the component located outside the first casing, and the detector located in the inner bore; and a second casing outside the first casing, the component comprising a control line extending through a space between the first and second casings.

9. An apparatus for use in a well, comprising:

a first casing having an inner bore and at least a first portion formed of a first material; and a detector to detect a signal associated with a component located beyond the first casing, wherein the first material has a property that reduces attenuation of the signal, the component located outside the first casing, and the detector located in the inner bore; and a second casing outside the first casing, the component located outside the second casing.

10. The apparatus of claim 9, wherein the first casing has a section that overlaps with a section of the second casing, the detector to detect an azimuthal location of the component through the first and second casing sections.

11. An apparatus for use in a well, comprising:

a component;

a tubular structure defining an inner bore and having a first portion formed of a non-ferromagnetic material, and wherein the tubular structure has at least a second portion formed of a ferromagnetic material; and a sonde lowered through the inner bore of the tubular structure, the sonde to emit a magnetic field and to detect a signal affected by the component located outside the tubular structure in response to the magnetic field, at least a portion of the magnetic field propagated through the first portion of the tubular structure, wherein the first portion has a property that reduces attenuation of the signal.

12. The apparatus of claim 11, wherein the tubular structure comprises a tubing string.

13. The apparatus of claim 11, wherein the tubular structure comprises a casing.

14. The apparatus of claim 11, further comprising a control module to detect an azimuthal location of the component based on the signal.

15. An apparatus for use in a well, comprising:

a first casing defining an inner bore and having at least a first portion formed of a non-ferromagnetic material;

a sonde positioned in the inner bore of the first casing, the sonde to emit a magnetic field and to detect a signal affected by a component located outside the first casing in response to the magnetic field, at least a portion of the magnetic field propagated through the first portion of the first casing; and a second casing that overlaps the first casing, wherein the component comprises a control line extending through a space between the first and second casings, the sonde to detect the signal affected by the control line located between the first and second casings.

16. An apparatus for use in a well, comprising:

a first casing defining an inner bore and having at least a first portion formed of a non-ferromagnetic material; and a sonde positioned in the inner bore of the first casing, the sonde to emit a magnetic field and to detect a signal affected by a component located outside the first casing in response to the magnetic field, at least a portion of the magnetic field propagated through the first portion of the first casing; and a second casing that overlaps the first casing, the sonde to detect the signal affected by the component located outside both the first and second casings.

17. A system comprising:

a detector;

a component; and a tubular structure having a first section formed of a first material, and the tubular structure further having at least a second section formed of a second material, wherein the first section of the tubular structure is located between the component and the detector;

the detector lowered through the tubular structure and to receive a signal associated with the component through the first section to enable detection of an azimuthal location of the component, wherein the first material attenuates the signal less than the second material.

18. The system of claim 17, the detector to receive the signal that results from magnetic field distortion caused by the component, the first material comprising a non-ferromagnetic material, and the second material comprising a ferromagnetic material.

19. The system of claim 17, the detector comprising an acoustic detector to receive an acoustic signal from the component, the first material having a lower acoustic reflection property than the second material.

20. The system of claim 17, the detector comprising a nuclear signal detector to receive a nuclear signal reflected from at least one of the component and a source in close proximity to the component.

21. A method of detecting an azimuthal location of a target component in a wellbore, comprising:

providing a detector into the wellbore and lowered through an inner bore of a tubular structure, wherein a first section of the tubular structure is located between the detector and the target component, and wherein the first section of the tubular structure is formed of a first material, and wherein the tubular structure further has at least a second section formed of a second material; and receiving, by the detector, a signal associated with the target component through the first section, wherein the first material has a property that attenuates the signal associated with the target component less than the second material.

22. The method of claim 21, wherein receiving the signal comprises receiving a signal selected from among a signal resulting from magnetic field distortion, an acoustic signal, and a nuclear signal.

23. The method of claim 21, wherein receiving the signal comprises receiving a magnetic signal inside the first section of the structure that is formed of a non-ferromagnetic material.

* * * * *